US005370415A

United States Patent [19]

Humphrey

[11] Patent Number: 5,370,415

[45] Date of Patent: Dec. 6, 1994

[54] SKI CONTROL SYSTEM WITH CARVE CONTROL AMPLIFICATION

[76] Inventor: John M. Humphrey, 15333 Via Del Sur, Monte Sereno, Calif. 95030

[21] Appl. No.: 1,191

[22] Filed: Jan. 7, 1993

[51] Int. Cl.[5] ..... A63C 7/10

[52] U.S. Cl. ..... 280/605; 280/606; 188/5

[58] Field of Search ..... 280/605, 602, 601, 604, 280/606, 608; 188/5, 6, 7, 8

[56] References Cited

U.S. PATENT DOCUMENTS

| | | | |
|---|---|---|---|
| 4,911,461 | 3/1990 | Humphrey | 280/605 |
| 4,986,561 | 1/1991 | Humphrey | 280/605 |
| 5,145,200 | 9/1992 | Humphrey | 280/605 |

FOREIGN PATENT DOCUMENTS

| | | | |
|---|---|---|---|
| 0590755 | 10/1924 | France | 280/605 |
| 2641763 | 3/1978 | Germany | 280/605 |
| 0530943 | 8/1955 | Italy | 280/605 |

*Primary Examiner*—Karin L. Tyson
*Assistant Examiner*—F. Zeender
*Attorney, Agent, or Firm*—John J. Leavitt

[57] ABSTRACT

A ski control system incorporating carve control amplification to activate by deployment of auxiliary ski control surfaces, such as a probe assembly resiliently mounted on the ski at or near the center of pressure of the ski, and which functions when deployed to impose control forces on the ski in proportion to the degree of carve of the ski.

17 Claims, 3 Drawing Sheets

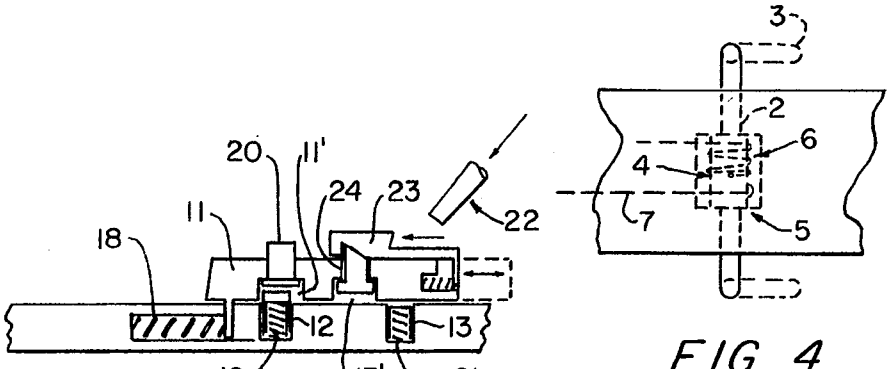
FIG. 4
FIG. 3
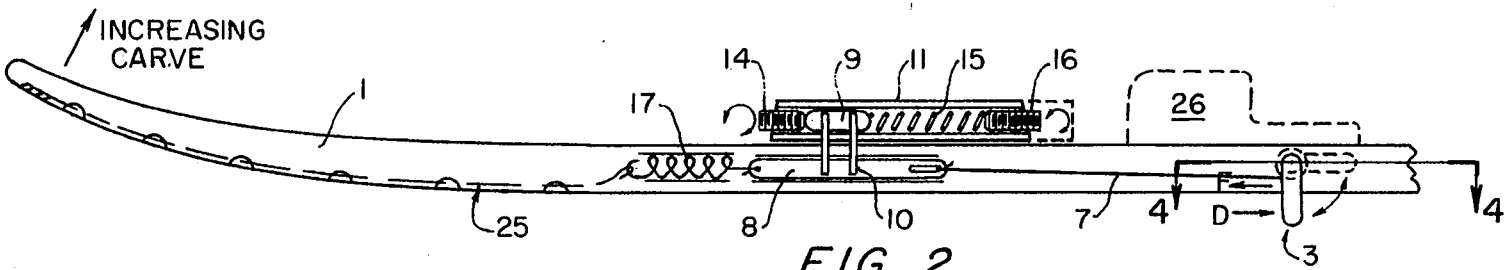
FIG. 2
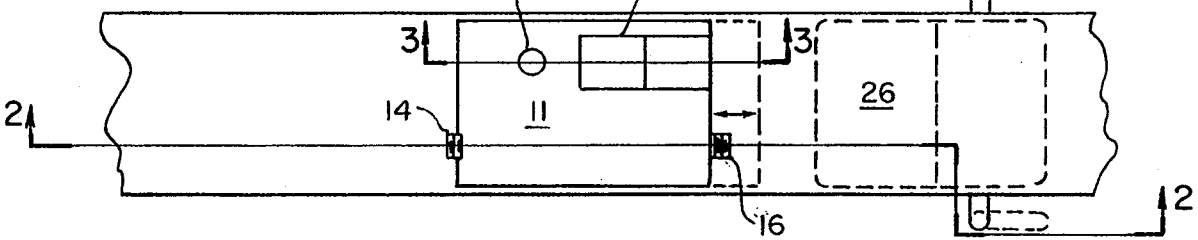
FIG. 1

SKI CONTROL SYSTEM WITH CARVE CONTROL AMPLIFICATION

BACKGROUND OF THE INVENTION

1. Field of the Invention

This invention relates to ski control devices and systems and particularly to a ski control system with carve control amplification that enhances the skier's ability to control speed and maneuverability on a downhill skiing run.

2. Description of the Prior Art

This invention provides improvements on the method and structure of the Ski Control System described in U.S. Pat. Nos. 4,986,561, 4,911,461 and 5,145,200 awarded to the inventor herein. The prior art that was considered in connection with these patents and determined to be non-applicable is identified in those patents and is included herein by reference. Similarly, the method and structure of the Ski Control System on which the invention herein disclosed provides further improvements is also thoroughly described in those patents and is included herein by reference. However a brief summary is provided of the prior inventions noted as an introduction to the improvements disclosed herein.

The Ski Control System (SCS) disclosed in the patents noted above consists of control probes on a downhill ski that may be deployed into engagement with the snow. Once deployed by the skier, the SCS probes remain resiliently deployed until specifically disengaged by the skier. The probes are located near the center of pressure of the ski so that they work with the ski to provide the skier with enhanced control over both speed and maneuverability. This enhanced control over speed and maneuverability is provided using natural skiing motions without any specific skier actions or motions required just to control the probes.

A downhill ski is, in effect, a flight vehicle, as is an airplane. However, unlike an airplane, a conventional downhill ski has no control surfaces to provide enhanced speed and maneuverability control. Control of a conventional downhill ski is achieved primarily by "carving" the ski, i.e., bending the body or "fuselage" of the flight vehicle, and thereby altering the distribution of load along the longitudinal axis of the ski. This distributed load can, depending on the location of the skier's center of gravity and the angle of attack of the ski, create both turning torques as well as lift and drag loads.

Conventional skis have no control surfaces, because control surfaces on any flight vehicle inevitably add drag. Conventional skis are designed to achieve minimum drag in order to provide maximum speed for racing skiers. However for most recreational skiing situations the objective of the skier is not to go as fast as possible, but to always ski at a speed where the skis are under control. For most recreational skiers, the slopes they should ski on and the speed they should achieve are limited by their ability to control the skis rather than by the maximum speed capability of the skis. These skiers can beneficially trade a little drag for an increase in maneuverability achieved by adding control surfaces to the skis. The additional maneuverability provided by the SCS increases the skier's safe control speed defined as the highest speed at which a given skier can remain in control under a given set of skiing conditions. The increase in safe control speed both enables recreational skiers to progress more rapidly to more interesting terrain and enables cautious recreational skiers to enjoy intermediate terrain with a greater control margin between the speed at which they are skiing and their safe control speed.

An important challenge of SCS design optimization, as with all flight vehicle control systems, is to provide enhanced control forces during maneuvers while minimizing drag forces under straight skiing conditions. Maximizing this control-force to drag ratio enhances skier control on the steeper parts of a run without significantly reducing the skier's speed on the flatter parts of the run. The SCS limits control probe axial forces (drag forces imposed in the axial direction of the ski at zero ski slip angle) by using resiliently retained probes whose penetration depth automatically adjusts in response to the axial force on the probes. Since probe drag force is a strong function of the probe penetration depth into the snow, probe depth variation controls the probe axial drag forces to be no greater than the applied spring force multiplied by the mechanical advantage of the mechanism. Unfortunately since control forces are related to axial forces, limiting the axial forces to control the drag also limits the forces available to execute maneuvers.

The SCS uses several techniques to maximize the control-force to drag-force ratio. The SCS structures in this invention are designed so that the spring force that resists probe retraction increases with probe retraction angle. Under flat skiing conditions a small probe rotation under a relatively weak spring force retracts the probes from the snow to minimize flat ski drag. However when the ski is on edge during maneuvers, a much larger probe rotation is required to retract the probe from the snow. This larger rotation requires a larger spring force which ensures higher available probe loads during maneuvers. Design of the shape of the probe further improves the control to drag ratio by presenting a streamlined low control force profile for straight skiing conditions and a high control force profile during maneuvers.

The SCS enables the skier to adjust SCS forces by adjusting both the maximum probe depth and the level of probe preload. Reducing the maximum probe depth reduces flat ski drag, but requires more edging to fully engage the SCS. This enables intermediate skiers to improve the SCS control to drag force ratio on groomed snow and enables all skiers to improve the SCS control to drag force ratio on hard snow where even slight edging fully engages the SCS. Increasing probe preload above the nominal setting increases both drag and control forces. A higher preload is often useful on hard snow in conjunction with a reduced probe depth.

The primary objective of this invention is to enhance the SCS probe control to drag ratio disclosed in the above noted patents by using the carve of the ski to amplify the SCS control forces. Since the skier increases the carve of the ski whenever he puts the ski on edge to execute a maneuver, using the carve of the ski to amplify SCS control forces provides an automatic enhancement of SCS control forces during maneuvers without any additional actions by the skier. This invention achieves enhanced SCS probe control forces under carved ski conditions (which are called "Carve Control Amplification" or "CCA") by providing a mechanical feedback between the carve of the ski and the preload acting on the SCS probes. When the ski is carved, the compression of the top surface of the ski is increased and the tension of the bottom (or running) surface of the ski is increased. The Carve (SCS) Control Amplification method utilizes the increased compression (shortening) over some length of the top surface of the ski or the increased elongation over some length of the bottom surface of the ski whenever the ski is carved to increase the spring force acting on the SCS probes. The two embodiments; presented herein illustrate two ways to use either bottom ski surface tension (elongation) or top ski surface compression (shortening), respectively, to achieve SCS preload amplification as the ski is carved. However, either design could achieve ski carve amplification of SCS preload using either top surface compression or bottom surface tension or even a combination of the two.

A further objective of this invention is to develop improved SCS structures which are compatible with the use of Carve Control Amplification to achieve enhanced SCS control to drag force ratios.

The invention possesses other objects and features of advantage, some of which, with the foregoing, will be apparent from the following description and the drawings. It is to be understood however that the invention is not limited to the embodiments illustrated and described since it may be embodied in various forms within the scope of the appended claims.

SUMMARY OF THE INVENTION

In terms of broad inclusion, the Ski Control System with Carve Control Amplification comprises the method and apparatus of using the carve of the ski to amplify the preload acting on Ski Control System probes with the SCS probes including the structures and methods presented herein to enhance the function and mode of operation of the previously referenced U.S. Pat. Nos. 4,986,561, 4,911,461 and 5,145,200 awarded to the inventor herein.

BRIEF DESCRIPTION OF THE DRAWINGS

FIG. 1 is a fragmentary top plan view of a portion of a ski illustrating the CCA invention integrally incorporated into the ski.

FIG. 2 is a fragmentary vertical cross-sectional view taken in the plane indicated by the line 2—2 in FIG. 1 and illustrating the CCA invention applied to the SCS control force omponents.

FIG. 3 is a fragmentary vertical cross-sectional view taken in the plane indicated by line 3—3 in FIG. 1 and illustrating the SCS engagement and disengagement (locking and release) components.

FIG. 4 is a fragmentary horizontal cross-sectional view of the probe/axle components taken in the plane indicated by line 4—4 in FIG. 2.

DESCRIPTION OF THE PREFERRED EMBODIMENT

Figure 6:
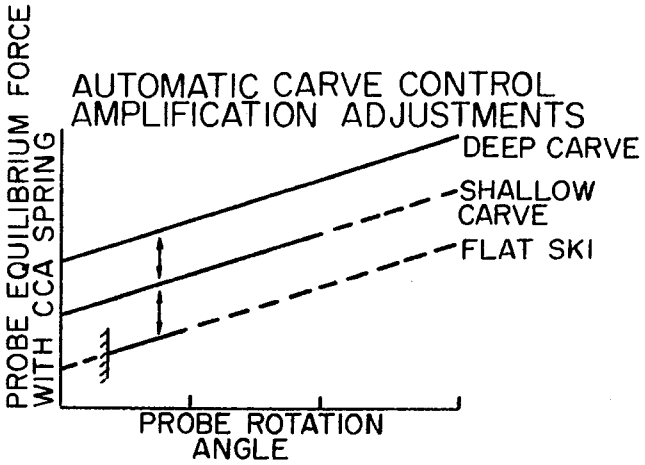
FIG. 6 is a graph of probe equilibrium force including the CCA spring force vs probe rotation angle.

In terms of greater detail and referring to the embodiment of the invention illustrated in FIG. 1, there is shown a downhill ski designated generally as numeral 1. Located on top of the ski is a slider plate 11 shown in the forward (engaged) position. As will be discussed in more detail in the following paragraphs, the slider plate has a disengagement button 20 which when depressed causes the slider plate to move aft to a disengaged position shown by the dashed lines. The slider plate also has an engagement slider 23 which when pushed forward allows the slider to move forward to the engaged position as shown in FIG. 3. The ski also has a binding toe peice 26. The SCS probes 3 of the type taught in U.S. Pat. Nos. 4,986,561, 4,911,461 and 5,145,200 are located generally underneath the toe piece. This axial location of the probes 3 in relation to the length of the ski is near the longitudinal center of pressure of the ski to enable the SCS control forces to work with the ski to provide enhanced maneuverability.

Referring to FIG. 4, located inside the ski is an SCS C probe/axle assembly. The probe/axle assembly comprises an axle 2, with SCS probes 3 on each end. The probes are shown both deployed for engagement with the snow in FIGS. 2 and 4 (solid lines) and retracted in FIG. 2 (dashed lines). The SCS axle 2 is attached to and extends concentrically through a rotatable sleeve 4 which abuts bearing surfaces 5 inside the ski to transfer lateral loads acting on the probes to the ski. A torsional probe return spring 6 is anchored at one end to the ski and is wrapped around the sleeve and anchored thereto and acts to normally move the probes to a retracted position. The probe/axle assembly is attached to the SCS control mechanism by a load cable 7 within the ski as shown, one end of which is partially wrapped around and anchored to the rotatable sleeve 4.

Referring To FIG. 2, the SCS control mechanism comprises a lower load rod 8 (also inside the ski) to which the other end of the load cable remote from sleeve 4 is attached. The lower load rod is connected to an upper load rod 9 by two load screws 10. The upper load rod translates axially inside the slider plate 11 which can slide axially on the upper surface of the ski. Forward motion of the upper load rod inside the slider is limited by the probe depth set screw 14. Aft motion of the upper load rod in relation to the slider plate 11 is resiliently restrained by the load spring 15 and the probe preload set screw 16 against which the spring abuts. Referring to FIG. 3, axial motion of the slider in relatioin to the ski is restrained by the lower engagement button 12 and the lower disengagement button 13.

It will aid in understanding the present invention to first consider SCS operation without either the Carve Control Amplification (CCA) spring 17 (FIG. 2) or the helper return spring 18 (FIG. 3). When the probes 3 are deployed to engage with the snow as shown by the solid outline, forward motion through the snow creates a drag force on the probes shown as arrow D. This drag force plus the torsional return spring torque act to impose retraction forces on the probes. These retraction forces are resisted by the tension in load cable 7 acting in the direction of arrow F which equals the load spring 15 force acting on the upper load rod 9 and reacting on the lower load rod 8 and finally on the load cable 7. As long as the load cable tension is less than the Load spring preload, the upper load rod 9 remains in contact with the probe depth set screw 14 and the probes 3 remain engaged at the depth set by the probe depth set screw.

Figure 5:
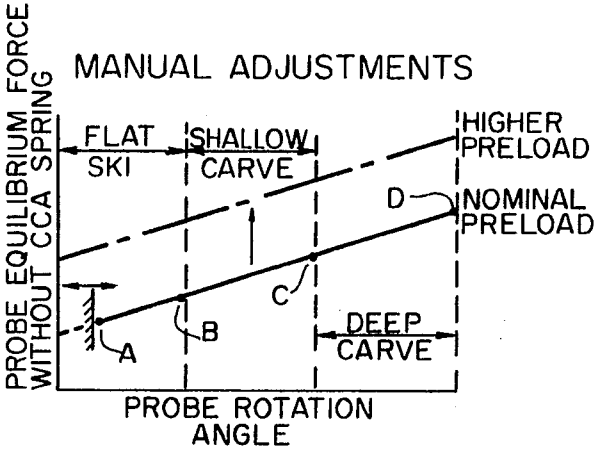
FIG. 5 is a graph of probe equilibrium force without the CCA spring force vs probe rotation angle.

The SCS probe force equilibrium is shown in the graph of FIG. 5. For this discussion the equivalent drag force D′ equals D multiplied by the drag force moment arm about the axle 2 centerline divided by the sleeve 4 radius. Similarly the equivalent torsional return spring 6 force R′ equals the return spring torque divided by the sleeve radius. When D′+R′ equal the load spring 15 preload, the upper load rod force on the probe depth set screw 14 falls to zero and the mechanism is in equilibrium with the drag force balanced by the spring forces as shown at point A on FIG. 5. As the drag force increases, the probe angle increases and the equilibrium force increases due to the compression of the load spring 15 and the relaxation of the return spring 6. Since SCS probe drag is a very strong function of probe depth, as the probe rotates to decrease the probe angle and probe depth decreases, drag force also decreases. This decrease in drag with diminished depth (i.e. probe rotation angle) and the increase in spring force with increase in probe rotation angle results in automatic attainment of an equilibrium probe rotation angle that matches spring force and drag.

The force generated at point B in FIG. 5 represents the maximum flat ski drag, because the probe rotation at point B results in minimal probe depth under flat ski conditions. However, as the skier performs maneuvers by putting the ski on edge, he increases the depth of the probe on the edge of the ski in contact with the snow. Therefore, for a shallow carve and for a deep carve, points C and D, respectively, in FIG. 5 represent the maximum drag forces that can be created by the SCS mechanism without the aid of carve control amplification. The progressive nature of the SCS equilibrium force curve means that both the drag forces and the related control forces (i.e. lift and turning torque) can be relatively high during manueuvers (when the ski is on edge) while keeping the maximum flat ski drag force relatively low. Increasing the preload raises the entire curve which provides higher equilibrium control forces (but also generates higher flat ski drag).

Disengagement and engagement of the SCS mechanism are accomplished as follows. Referring to FIG. 3, when the SCS is engaged, aft motion of the slider is prevented by the lower engagement button 12 which is raised by a lower engagement button spring 19, allowing the upper end portion of the button 12 to project into an accommodating recess 11′ in plate 11 to lock the slider in the forward engaged position as shown. However, depressing the upper engagement button 20 against the resilient force of spring 19 allows the torsional return spring 6 and any probe drag to pull the slider aft until the lower disengagement button 13, spaced in an axial direction from button 12, can be elevated by the lower disengagement button spring 21 into recess 13′ in plate 11 and lock the slider into the aft disengaged position shown in FIGS. 1, 2 and 3 in borken lines. From this position of locked disengagement or complete retraction of the probes 3, probe deployment is accomplished by using the tip of the ski pole 22 to move the spring-pressed engagement slider 23 forwardly in the direction of the arrow. This movement of the slider cams and depresses the upper disengagement button 24 which abuts the end of button 13 projecting into recess 13′ and unlocks the lower disengagement button 13 from the recess. Further force on the spring-pressed engagement slider 23 in the direction of the arrow moves the entire slider 11, on which the engagement slider 23 is mounted, forward until the lower engagement button 12 engages the recess 11′ and locks the slider in the engaged position.

The preceding discussion described the operation of the preferred SCS embodiment without. The addition of the Carve Control Amplification components. The following discussion describes the function of these additional carve control amplification components in operative association with the SCS components. Carve Control Amplification adds a CCA cable 25 inside the ski attached to the tip of the ski and guided along the lower part of the ski as shown. The CCA cable is attached to the lower load rod 8 by the CCA spring 17. The functional effect of these CCA components on the CCA equilibrium force curve is presented in FIG. 6.

The equilibrium probe force vs probe rotation angle line under flat ski conditions with the CCA spring is similar to the force line in FIG. 5 without the CCA spring only slightly steeper due to the added spring constant of the CCA spring. However when the skier performs a maneuver that puts the ski into a shallow carve, the carve of the ski puts the lower surface of the ski in tension. Tension means that the lower surface of the ski is undergoing positive strain. Since the CCA cable 25 is attached to the tip of the ski and guided along the lower surface of the ski, carving the ski pulls the cable which stretches the CCA spring 17. This higher CCA spring force is translated into higher SCS probe preload which raises the entire force equilibrium curve. As the skier increases the amount of carve, he further increases the CCA spring preload and thereby further increases the probe force equilibrium curve. The CCA components significantly increase the probe equilibrium forces over the full range of probe rotation angles when the ski is carved without increasing the flat ski drag forces when the ski is not carved. This enhances the ability of the SCS to provide additional control forces during skiing maneuvers while achieving even lower flat ski drag. The SCS probe control forces automatically increase with the extent of carve to amplify the control provided by the basic SCS-equipped ski. The helper return spring 18 is added to balance the CCA spring force to provide positive disengagement when the disengagement button 20 is depressed.

The motion of a ski across the surface of the snow is a dynamic response that results in oscillations of the depth of carve of the ski. For most recreational skiing conditions the damping characteristics of modern skis keep the carve oscillations under control and the oscillations are of a sufficiently high frequency so as to not be objectionable. CCA tends to stiffen the ski (through the force on the cable) and this stiffening needs to be accounted for in both the stiffness and the damping characteristics of the ski. If necessary, the CCA mechanism could include additional damping to smooth out probe force oscillations due to vibrations in the carve of the ski. This damping could be achieved in several ways. For example, one could add viscous damping at the connection between the CCA cable 25 and the CCA spring 17. Another damping approach would be to split the CCA spring with a mass that would filter out high frequency carve oscillations and transmit an averaged carve displacement force to the probes. Since additional damping is not considered to be necessary, the preferred embodiment does not show these additional damping components.

The embodiment of the invention illustrated in FIGS. 7–12 is very similar to the preferred embodiment except that the control mechanism is mounted inside the binding and the Carve Control Amplification components use the compression on the upper surface of the ski between the toe piece and the heel piece (rather than the tension over the forward half of the lower surface of the ski) to provide carve amplification of SCS probe preload.

Figure 7:
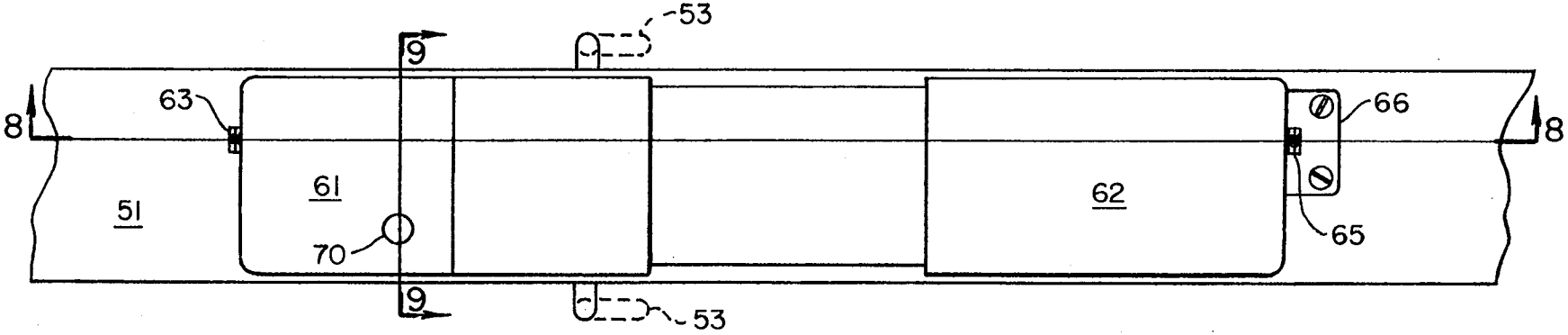
FIG. 7 is a fragmentary top plan view of a portion of a ski illustrating the CICA invention with the SCS probes integrally mounted into a downhill ski and the SCS control mechanism (including CCA) integrally mounted in the ski binding including the toe piece and heel piece.

Referring to the embodiment of the invention illustrated in FIG. 7, there is a downhill ski designated generally as numeral 51. Located on the top surface of the ski is a toe piece 61 and a connected heel piece 62. The toe piece has an engagement button 70 and a probe depth set screw 63. Also visible are the SCS probes 53 shown deployed in full lines and retracted in broken lines.

Figure 10:
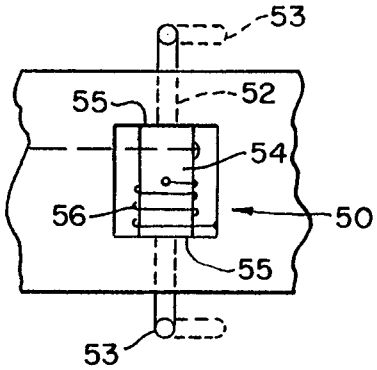
FIG. 10 is a fragmentary horizontal cross-sectional view of the probe/axle components taken in the plane indicated by the line 10—10 in FIG. 8.

Referring to FIG. 10, located in a recess inside the ski is an SCS probe/axle assembly designated generally by the numeral 50. The probe/axle assembly is located near the longitudinal center of pressure of the ski (which is typically underneath the toe piece 61) to enable the SCS control surfaces and forces to work with the ski to provide enhanced maneuverability. The probe/axle assembly comprises an axle 52, with SCS probes 53 on each end. The probes are shown deployed for engagement with the snow (solid lines) and retracted (dashed lines). The SCS axle 52 is attached to and extends concentrically through a sleeve 54 which abuts bearing surfaces 55 inside the ski to transfer lateral loads acting on the probes to the ski. A torsional probe return spring 56 is anchored at one end to the ski and is wrapped around the sleeve and anchored thereto and acts to normally move the probes to a retracted position. The probe/axle assembly is attached to the SCS control mechanism by a load cable 57 one end of which is partially wrapped around and anchored to the rotatable sleeve 54.

The SCS control mechanism comprises a lower load rod 58 (also inside the ski) to which the other end of the load cable remote from sleeve 54 is attached. All other control mechanism components in this; embodiment are incorporated into the ski binding. The lower load rod 58 is connected to an upper load rod 59 by two load screws 60. The upper load rod translates axially in relation to the ski underneath the binding which includes the toe piece 61 and the heel piece 62. The upper load rod forms the only ski binding axial restraint on the ski between these two binding pieces. Forward motion of the upper load rod 59 inside the slider is limited by the probe depth set screw 63. Aft motion of the upper rod is resiliently restrained by the load spring 64 and the probe preload set screw 65.

The binding is designed so that the heel piece 62 is not axially attached to the ski, but is axially restrained by a connection to the toe piece. This allows the ski to flex more freely without being constrained by the ski boot. However the upper load rod aft mount 66 is rigidly mounted to the ski and slides axially relative to the heel piece. When the skier puts the ski on edge, the resulting carve of the ski puts the upper surface of the ski into compression. Since the heel piece attachment does hoe restrict the carve of the ski, carving the ski increases the compression of the load spring 64 which increases the SCS probe preload. The greater the depth of carve, the greater the increase in SCS probe preload. Therefore, this embodiment achieves Carve Control Amplification of SCS preload using the compression of the ski between the toe piece and a location underneath a sliding heel piece whereas the structure shown in FIGS. 1–4 achieved CCA using the tension in the ski between the tip of the ski and the toe piece. Similarly, the change in tension or compression of other parts of the ski when the ski is carved could be used to amplify SCS preload.

The form of the invention shown in FIGS. 1–4 uses force to engage the SCS and engage a latch which holds the SCS engaged. An upper disengagement button is used to release this latch and allow for a quick disengagement. As explained below, the form of the invention shown in FIGS. 7–12 reverses this approach with a forced disengagement permitting a quick engagement. Either engagement approach (i.e. quick disengagement as in FIGS. 1–4 or quick engagement as in FIGS. 7–12) could be used with either form of the invention to simplify one half of the SCS engagement/disengagement process.

Figure 11:
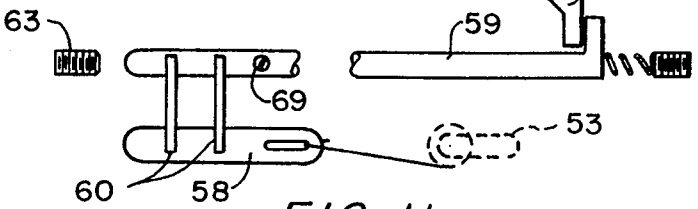
FIG. 11 is a diagrammatic view of the components of FIG. 8 with the heel piece open and the SCS disengaged.
Figure 12:
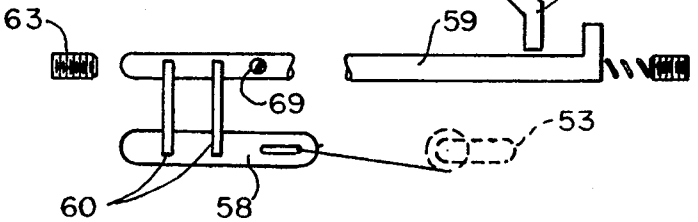
FIG. 12 is a diagrammatic view of the components of FIG. 8 with the heel piece closed and the SCS disengaged.
Figure 9:
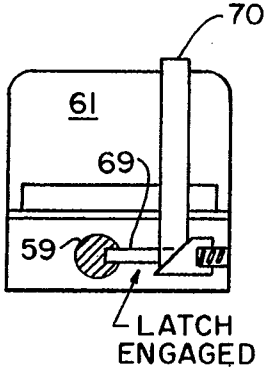
FIG. 9 is a vertical cross-sectional view taken in the plane indicated by the line 9—9 in FIG. 7, illustrating the SCS engagement and disengagement latch.
Figure 8:
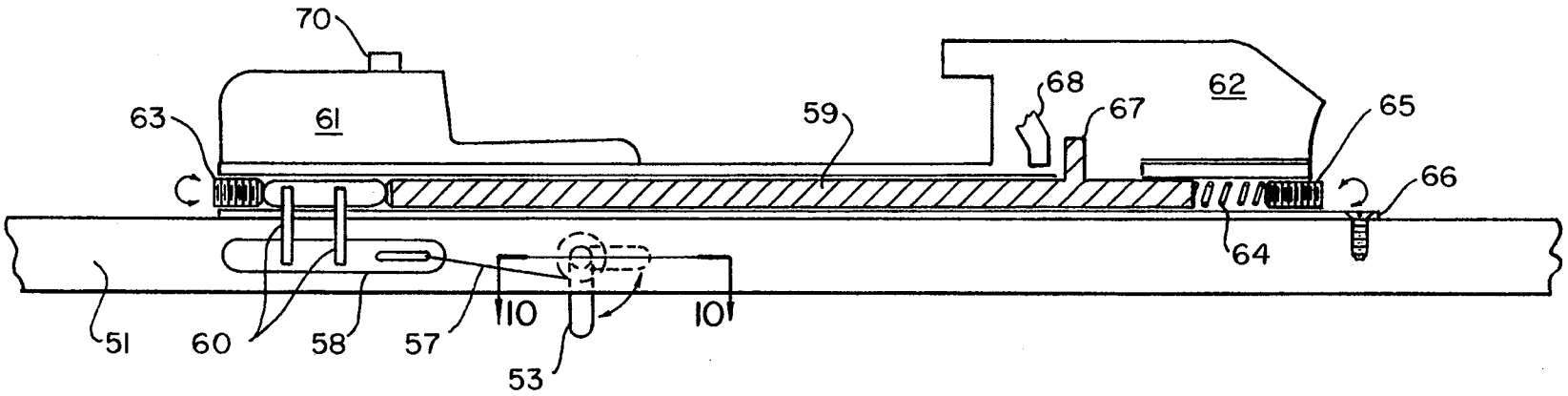
FIG. 8 is a fragmentary vertical cross-sectional view taken in the plane indicated by the line 8—8 in FIG. 7 illustrating the heel piece closed and SCS engaged and latch 69 disengaged.

In the form of the invention shown in FIGS. 7–12, the upper load rod 59 has a catch 67 adjacent its aft end. As shown in FIG. 8, the heel piece has an arm 68 that engages the catch whenever the heel piece is opened either manually or automatically during a fall. This arm pushes the catch 67 (and the whole upper load rod 59) aft and disengages the SCS probes (FIG. 11). As shown in FIG. 9, opening the heel piece also engages a toe piece latch 69 at the forward end of the upper load rod 59. As shown in FIG. 12, whenever the heel piece is closed, the latch remains engaged thus holding the SCS in the disengaged position. The skier may quickly engage the SCS by pressing the engagement button 70 on the toe piece. Pressing the engagement button 70 retracts the toe piece latch 69 thus allowing the load spring 64 to move the upper load rod 59 forward and engage the probes.

The embodiment of the invention presented in FIGS. 7–12 locates most of the control components inside the binding, but locates the probe/axle assembly inside the ski. Placing the probe/axle assembly inside the ski, as opposed to locating the axle inside the toe piece, minimizes the distance from the axle to the point of application of the drag on the probe. This reduces the torque on the axle and thereby reduces the magnitude of the spring force and facilitates miniaturization of the SCS mechanism. However as presented in U.S. Pat. No. 5,145,200, the SCS axle can also be incorporated into the binding. Therefore, by thickening the toe piece slightly, the embodiment of the invention presented in FIGS. 7–12 could have incorporated all the SCS components with Carve Control Amplification into the binding. This approach facilitates commercial interfaces by allowing a binding manufacturer to produce and sell a complete SCS with CCA without interfacing with a ski manufacturer. Similarly, the embodiment of the invention presented in FIGS. 1-4 is totally contained within the ski and allows a ski manufacturer to produce a completely self-contained product.

Having thus described the invention, what is believed to be new and novel and sought to be protected by letters patent of the United States is as follows.

I claim:

1. A method enabling a skier to control downhill skis having bottom running surfaces defined by lateral side edge surfaces and adapted to slide on a body of snow with which said bottom surfaces are in contact during a downhill ski run to enable enhanced maneuverability of said skis through execution of conventional body movements applied at the center of pressure of said skis, said method comprising the steps of:

a) providing laterally spaced control surfaces on each of said downhill skis near the center of pressure of each downhill ski generally adjacent a toe piece fixedly secured to each said downhill ski and spaced from said lateral side edge surfaces which define said bottom running surface of said ski;

b) operatively deploying said spaced control surfaces from a non-deployed retracted position into extended penetrating engagement with the snow below said running surfaces;

c) causing said spaced control surfaces to selectively interact with the body of snow during a downhill ski run for selectively imposing a drag force to said skis;

d) transmitting conventional body movements of the skier to said downhill skis and to said control surfaces during said downhill ski run, said conventional body movements including selectively shifting the weight of the skier laterally with respect to the longitudinal axis of each ski to rotate each ski about its respective longitudinal axis, thereby varying the penetrating engagement with the snow of said spaced control surfaces on each of said downhill skis to increase the drag force on one control surface of each ski and decrease the drag force on the other control surface of each ski to generate a rotational moment of force in each said downhill ski about said laterally spaced control surface on which the drag has been increased for enhancing maneuverability of said ski;

e) causing a resilient restraint to be imposed on said control surfaces to enable said control surfaces to partially retract from a selected maximum engagement depth deployment with the snow whereby resilient equilibrium at a shallower depth of engagement is achieved when the drag force on said control surfaces initially deployed at said selected maximum depth subsequently exceeds a user set resilient preload and enabling re-deployment of said control surfaces to said selected maximum engagement depth when the drag force falls below said preload; and f) causing the longitudinal carve of the downhill ski to automatically vary the magnitude of the resilient preload on said control surfaces whereby whenever the ski is longitudinally carved the resilient preload increases automatically without any additional action by the skier so that a greater drag force is required on the control surfaces to resiliently partially retract said control surfaces from the selected maximum engagement depth.

2. The method according to claim 1, wherein the longitudinal carve of the ski effects an elongation of the lower surface of the ski, and the amount of carve and the proportional increase in elongation of the lower surface of the ski effected thereby are applied to increase the resilient preload on the control surfaces.

3. The method according to claim 1, wherein the longitudinal carve of the ski effects longitudinal compression of the upper surface of the ski and consequent proportional shortening thereof and the amount of carve and the proportional shortening of the upper surface of the ski effected thereby are applied to increase the resilient preload on the control surfaces.

4. As an article of manufacture, a downhill snow ski having a forward tip end portion and top and bottom surfaces defined by right and left side edges and including a ski control system operatively incorporated therein, comprising:

a) a drag probe assembly mounted on said downhill ski, said assembly including right and left drag probes correlated to the right and left side edges of said downhill ski and selectively deployable from a retracted position of non-engagement with the snow through a range of intermediate partially extended positions of engagement with the snow to a fully extended position of engagement wherein the drag probes maximally penetrate the snow;

b) means to resiliently control the drag probe penetration of the snow whereby the instantaneous degree of probe penetration depth is a function of the instantaneous drag force imposed on the probes by the snow; and c) connection means between the forward tip end portion of the ski and said means providing resilient control of the drag probes and responsive to an increase in the longitudinal bending of the ski to effect an increase in the magnitude of resilient control force on the drag probes.

5. The article of manufacture according to claim 4, in which said connection means between the forward tip end portion of the ski and said means providing resilient control of the drag probes is connected to the ski adjacent the bottom surface of the ski whereby an increase in the longitudinal bending of the ski increases longitudinally imposed tension on said connection means and effects an increase in the resilient control force on the drag probes proportional to said increase in tension in said connection means.

6. The article of manufacture according to claim 4, in which said connection means is connected to the ski whereby an increase in the longitudinal bending of the ski compresses said connection means to effect an increase in the resilient control force on the drag probes.

7. A method enabling a skier to control downhill skis having bottom running surfaces defined by lateral side edge surfaces and adapted to slide on a body of snow with which said bottom surfaces are in contact during a downhill ski run to enable enhanced maneuverability of said skis through execution of conventional body movements applied at the center of pressure of said skis, said method comprising the steps:

a) providing laterally spaced control surfaces on each of said downhill skis near the center of pressure of each downhill ski generally adjacent a toe piece and fixedly secured to each said downhill ski and spaced from said lateral side edge surfaces which define said running surface of said ski;

b) operatively deploying said spaced control surfaces from a non-deployed retracted position into a deployed extended position wherein the control surfaces may penetrate and engage the snow adjacent said side edge surfaces to a depth below said running surfaces during the downhill ski run to selectively interact with the body of snow during the downhill ski run for selectively imparting a drag force to said skis;

c) transmitting conventional body movements of the skier to said downhill skis and to said control surfaces during said downhill ski run, said conventional body movements including selectively shifting the weight of the skier laterally with respect to the longitudinal axis of each ski to rotate each ski about its respective longitudinal axis, thereby varying the penetrating engagement with the snow of said spaced control surfaces on each of said downhill skis to increase the drag force on one control surface of each ski and decrease the drag force on the other control surface of each ski to generate a rotational moment of force in each said downhill ski about said control surface on which the drag has been increased for enhancing maneuverability of said ski;

d) causing a resilient restraint to be imposed on said control surfaces to enable said control surfaces to partially retract from a maximum engagement depth deployment with the snow whereby resilient equilibrium at a shallower depth of engagement is achieved when the drag force on said control surfaces initially deployed at said maximum engagement depth subsequently exceeds a user set resilient preload and enabling re-deployment of said control surfaces to said maximum engagement depth when the drag force falls below said preload; and e) causing the longitudinal carve of the downhill ski to automatically provide a progressive loading profile for the resilient control force on said control surfaces wherein rotation of the probes toward a retracted position in the absence of carve of the ski is minimally restrained to provide a low probe angle and consequentially a low drag force when the skis are flat on the snow and a high probe angle and consequentially a high drag force when the skis are carved and the resilient control force on the probes is thereby increased so that the high probe rotation angle and the resultant high control forces provided by the probes enables enhanced ski control during maneuvers.

8. The method enabling a skier to control a pair of downhill skis, each ski having a bottom running surface defined by lateral side edge surfaces and each ski equipped with a ski control system including a drag probe adjacent each lateral side edge surface deployable from a retracted inactive position above the plane of said bottom running surface to an active position below the plane of said bottom running surface in which the probes are in physical contact with a body of snow during a downhill run so as to enable enhanced ski maneuverability of said skis through execution of conventional body movements applied at the center of pressure said skis to effect carve of said skis, said method comprising harnessing the extent of carve of the skis to apply localized control forces to said drag probes corresponding to the extent of carve when said drag probes are deployed in the active position.

9. The method according to claim 8, wherein said drag probes are caused to be resiliently retained at varying angles of deployment between said active and inactive positions in response to the extent of carve of the skis resulting in the application of localized control forces to the drag probes.

10. The method according to claim 9, wherein the control forces are caused to increase in proportion with an increase of carve of the skis.

11. The method according to claim 10, wherein elongation of the bottom running surface of the ski by carve of the ski is utilized to apply said control forces on said drag probes when deployed in an active position.

12. The method according to claim 10, wherein compression of the top surface of the ski by carve of the ski is utilized to apply said control forces on said drag probes when deployed in an active position.

13. The article of manufacture according to claim 4, wherein said means to resiliently control the drag probe penetration of the snow as a function of the drag force imposed on the probes by the snow includes a slider plate slidably mounted on the top surface of the ski for movement between an aft position correlated to a refracted position of the probes and a forward position correlated to a fully deployed position of the probes; means for selectively releasably Latching the slider plate in aft and forward positions, interconnected upper and lower Load rods slidably associated respectively with said slide plate and said ski, spring means mounted on said slider plate and resiliently biasing said upper load rod in a forward direction in relation to the slider plate so as to impose a resilient bias on said probes tending to retain them in deployed position, a load cable connected between said probe assembly and said lower load rod to impose said resilient bias on said probes tending to retain them in deployed position, and said connection means connects the forward tip end portion of the ski with the end of said lower load rod opposite the end thereof connected to said load cable.

14. The article of manufacture according to claim 13, wherein adjustment means are provided on said slider plate selectively adjustable to limit slidable movement of said upper load rod in one direction.

15. The article of manufacture according to claim 13, wherein adjustment means are provided on said slider plate selectively adjustable to increase or decrease the degree of resilient bias imposed on said upper load arm whereby to control the degree of drag force required to be imposed on said drag probes to deflect them in the direction of retraction.

16. The article of manufacture according to claim 13, wherein means are provided interposed between said slider plate and said ski whereby said slider plate is resiliently biased toward said aft position.

17. The article of manufacture according to claim 13, wherein said connection means between the forward tip end portion of the ski and said lower load rod includes a resilient extension spring connected at one end to said load rod and a flexible non-resilient load cable connected by one end to the opposite end of said extension spring and at its end remote from said extension spring connected to the forward tip end portion of the ski, whereby carve of the ski imposes tension on said load cable and on said extension spring wherey to increase the drag force on said probes required to effect deflection thereof toward a retracted position.

* * * * *